US006391206B2

(12) United States Patent
Chihara et al.

(10) Patent No.: US 6,391,206 B2
(45) Date of Patent: May 21, 2002

(54) METHOD FOR RECOVERY OF AQUEOUS WASH IN PHOSPHATE CHEMICAL CONVERSION AND APPARATUS FOR METAL SURFACE TREATMENT

(75) Inventors: Hiroshi Chihara, Kawasaki; Seiichiro Shirahata, Toyonaka; Syoji Shiraishi, Fujisawa; Naoki Tada; Toshiyuki Kawashima, both of Shiga; Hideaki Morita, Toyota; Yutaka Ohashi, Nisshin, all of (JP)

(73) Assignee: Nippon Paint Co., Ltd., Osaka (JP)

( * ) Notice: Subject to any disclaimer, the term of this patent is extended or adjusted under 35 U.S.C. 154(b) by 0 days.

(21) Appl. No.: 09/732,867

(22) Filed: Dec. 11, 2000

(30) Foreign Application Priority Data

Dec. 9, 1999 (JP) ..... 11-350524

(51) Int. Cl.[7] ..... B01D 61/00
(52) U.S. Cl. ..... 210/652; 210/651; 210/638
(58) Field of Search ..... 210/651, 652, 210/805, 195.2, 638

(56) References Cited

U.S. PATENT DOCUMENTS 5,348,558 A * 9/1994 Winston
5,766,479 A * 6/1998 Collentro et al.
5,776,351 A * 7/1998 MacGinness et al.
6,284,059 B1 * 9/2001 Zupancich
2001/0017282 A1 * 8/2001 Chihara et al.

FOREIGN PATENT DOCUMENTS

JP 09206749 * 12/1997

* cited by examiner

*Primary Examiner*—Ana Fortuna
(74) *Attorney, Agent, or Firm*—Connolly Bove Lodge & Hutz LLP

(57) ABSTRACT

This invention is related to a method for recovery of aqueous wash in a phosphate chemical conversion of a shaped metal product involving carrying out chemical conversion and subsequent cleaning with water, wherein said cleaning with water is performed in one or more stages and comprises a step of withdrawing aqueous wash from a first cleaning stage and adjusting the pH of the wash with at least one acid selected from the group consisting of phosphoric acid, nitric acid, hydrofluoric acid, hydrosilicofluoric acid and fluoroboric acid, a step of treating said pH-adjusted aqueous wash with a first reverse osmosis membrane to separate it into a first filtrate and a first concentrate, and a step of neutralizing said first filtrate with an alkali and treating the alkali-neutralized filtrate with a second reverse osmosis membrane to separate it into a second filtrate and a second concentrate, said first concentrate being recycled for said phosphate chemical conversion, said second filtrate being recycled as aqueous wash for said aqueous cleaning, and said second concentrate being discarded from the system.

5 Claims, 1 Drawing Sheet

METHOD FOR RECOVERY OF AQUEOUS WASH IN PHOSPHATE CHEMICAL CONVERSION AND APPARATUS FOR METAL SURFACE TREATMENT

FIELD OF THE INVENTION

The present invention relates to a method for recovery of aqueous wash in a phosphate chemical conversion and an apparatus for metal surface treatment.

PRIOR ART

The phosphate chemical conversion has been frequently used in the pretreatment of shaped metal products prior to coating. In this phosphate chemical conversion, the shaped metal product must be cleaned with water after the chemical conversion treatment. This cleaning involves multi-stage washing with water and in the final stage of cleaning, fresh aqueous wash is used. The overflow of this water is recycled serially to the preceding stages and a portion of the washes from the first stage is discharged from the system, whereby the contaminant concentration of water in each stage is controlled so as to maintain a steady chemical conversion treatment. The aqueous wash from the first stage contain metal ions such as zinc, nickel and manganese ions, as well as ingredients of the phosphate chemical conversion such as phosphate ions, nitrate ions, hydrofluoric acid, hydrosilicofluoric acid, fluoroboric acid, etc., which, if discharged as they are, cause pollution of river and other water. Therefore, it is common practice to pool these washes with other plant effluents and subject the pooled water to flocculation-sedimentation or biological treatment before disposal.

Referring to the aqueous wash produced in such a phosphate chemical conversion, various methods utilizing reverse osmosis membranes for recovery of useful components and for reducing the amount of effluents have been reported. In order to improve the rate of recovery of useful components by a reverse osmosis technique, it already belongs to the known technology to install two reverse osmosis membrane modules in series so that the concentrated water produced in the first module is further treated in the second module to give a concentrated water and a filtrate. However, when the aqueous wash to be treated contains substances which will form precipitates on the membrane-water interface, such as metal salts, chances for precipitation of such substances on the membrane surface of the second reverse osmosis module are high so that the membrane flux of the second reverse osmosis module drops gradually. The resultant disadvantage is that the equipment cannot be operated on a steady basis for many hours.

On the other hand, it is well known that in order to further improve the quality of the filtrate, the filtrate may be recycled to the first reverse osmosis module to thereby reduce the ion concentration of the aqueous wash to the first reverse osmosis module. Furthermore, Japanese Kokai Publication Hei-9-206749 discloses a method which comprises supplying an antiscaling agent to the water to be treated and adding an acid to the concentrate obtained in the first module before feeding it to the second reverse osmosis module. However, this method is disadvantageous in that a filtrate of good quality cannot be obtained, for instance. In addition, neither of these methods offers a solution to the problem of said build-up of precipitates on the membrane-fluid interface.

SUMMARY OF THE INVENTION

The object of the present invention is to provide a method and an apparatus for efficient recovery of a useful component and production of a filtrate of improved quality by means of reverse osmosis membranes from the aqueous wash produced in a phosphate process for surface chemical conversion of a shaped metal product.

The present invention is relates to a method for recovery of aqueous wash in a phosphate chemical conversion of a shaped metal product involving carrying out chemical conversion and subsequent cleaning with water, wherein said cleaning with water is performed in one or more stages and comprises a step of withdrawing aqueous wash from a first cleaning stage and adjusting the pH of the wash with at least one acid selected from the group consisting of phosphoric acid, nitric acid, hydrofluoric acid, hydrosilicofluoric acid and fluoroboric acid, a step of treating said pH-adjusted aqueous wash with a first reverse osmosis membrane to separate it into a first filtrate and a first concentrate, and a step of neutralizing said first filtrate with an alkali and treating the alkali-neutralized filtrate with a second reverse osmosis membrane to separate it into a second filtrate and a second concentrate, said first concentrate being recycled for said phosphate chemical conversion, said second filtrate being recycled as aqueous wash for said aqueous cleaning, and said second concentrate being discarded from the system.

In said pH adjusting step, phosphoric acid may be used as the acid and the pH is adjusted to 2.0 to 3.0.

The apparatus for metal surface treatment according to the present invention is for use in a phosphate chemical conversion of a shaped metal product, which comprises a phosphate chemical conversion means, a means for performing aqueous cleaning in one or more stages, a means for withdrawing aqueous wash from a first stage of said aqueous cleaning means and adjusting the pH of the aqueous wash with an acid selected from the group consisting of phosphoric acid, nitric acid, hydrofluoric acid, hydrosilicofluoric acid and fluoroboric acid, a first reverse osmosis membrane module for treating the pH-adjusted aqueous wash, a means for alkaline neutralization of a filtrate from said first reverse osmosis membrane module, and a second reverse osmosis membrane module for treating the alkaline-neutralized filtrate.

In said apparatus for metal surface treatment, a concentrate from said first reverse osmosis membrane module may be recycled for said phosphate chemical conversion and a filtrate from said second reverse osmosis membrane module may be recycled as aqueous wash for aqueous cleaning.

The aqueous wash mentioned just above may be from the last stage of aqueous cleaning.

BRIEF DESCRIPTION OF NUMERIC SYMBOLS

1. boat-shaped chemical conversion tank

2. first cleaning tank

3. last cleaning tank

4. pH adjusting tank

5. pH control agent reservoir

6. first reverse osmosis membrane module

7. neutralizing tank

8. alkali reservoir

9. second reverse osmosis membrane module

50. apparatus for metal surface treatment

DETAILED DESCRIPTION OF THE INVENTION

Figure 1:
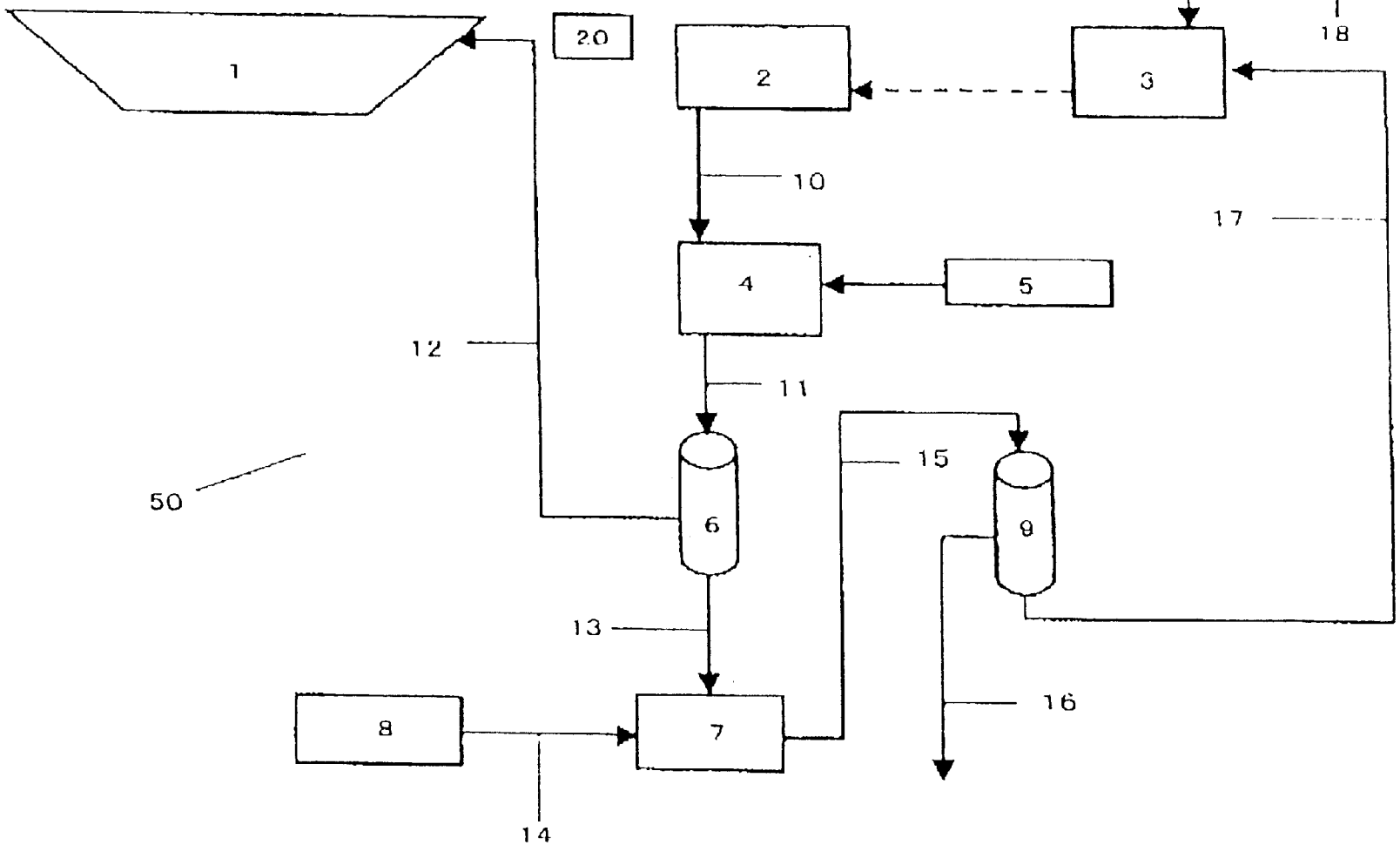
FIG. 1 is a flow diagram showing an embodiment of the apparatus for metal surface treatment in accordance with the present invention.

Generally in a metal surface treatment of shaped metal products, such as automotive bodies, the product is transported by conveyer means serially through the degreasing stage, aqueous cleaning stage, surface conditioning stage, chemical conversion stage, and post-conversion aqueous cleaning stage. The method for recovery of aqueous wash and the apparatus for metal surface treatment, both in accordance with the present invention, pertain to said chemical conversion treatment stage and post-conversion aqueous cleaning stage.

The present invention is now described in detail, reference being had to FIG. 1 which shows an example of the apparatus for metal surface treatment according to the invention.

A shaped metal product undergoing the conventional degreasing, post-degreasing aqueous cleaning and surface conditioning is dipped in a chemical conversion solution in a boat-shaped chemical conversion tank 1, in which said chemical conversion is carried out. The chemical conversion reagent solution for use in this process is not particularly restricted as far as it contains a phosphate but may for example be a zinc phosphate agent.

The shaped metal product 20 subjected to this chemical conversion treatment is transported by conveyer means to an aqueous cleaning stage comprising a plurality of cleaning tanks, namely a first cleaning tank 2 ~ a last cleaning tank 3, where it is invariably cleaned with water. This cleaning can be carried out by the full-dip method, the spray method, or a combination thereof. If necessary, the last cleaning tank may be provided with a mist sprayer or the like. In the above multistage aqueous cleaning system, the last cleaning tank 3 is supplied with a predetermined amount of fresh cleaning water through a pipe 18 and the water so supplied overflows to the preceding cleaning tank and finally reaches the first cleaning tank 2 (indicated by the dot line in the figure). The amount of fresh aqueous wash is so selected that the concentration of the chemical conversion agent in said first cleaning tank 2 will be equivalent to a 10-fold dilution of the original chemical conversion agent.

In the present invention, the cleaning water overflowing the first cleaning tank 2 is fed through a piping 10 to a pH adjusting tank 4. In this pH adjusting tank 4, the water is adjusted to a pH value within the range of, preferably, 2.0 to 3.0 with an acid stored in a pH control agent reservoir 5. Adjusting the pH to less than 2.0 is objectionable for the water exerts a deleterious effect on the reverse osmosis membrane. Exceeding pH 3.0 is also objectionable, for zinc phosphate and other precipitates are deposited on the reverse osmosis membrane. By controlling the pH of the cleaning water within the above-mentioned range, the rate of permeation of nitrate and sodium ions through the membrane in the first reverse osmosis membrane module can be properly controlled to provide a filtrate suited for reutilization in the chemical conversion stage. The acid mentioned above may be an aqueous solution of at least one of phosphoric acid, nitric acid, hydrofluoric acid, hydrosilicofluoric acid, and hydrofluoroboric acid, although an aqueous solution of phosphoric acid is preferred.

The pH-adjusted water is fed through a piping 11 to the first reverse osmosis membrane module 6. In this first reverse osmosis membrane module 6, the pH-adjusted water is subjected to reverse osmosis to give a first filtrate and a first concentrate. The first concentrate is withdrawn through a concentrate withdrawal pipe 12 connected at one end to the concentrate outlet of the first reverse osmosis membrane module 6 and fed to the chemical conversion tank 1, whereby it is reutilized as a chemical conversion agent.

On the other hand, the first filtrate is fed to an alkaline neutralizing tank 7 through a first filtrate withdrawal line 13 connected at one end to the filtrate outlet of said first reverse osmosis membrane module.

The reverse osmosis membrane of said first module has a sodium chloride rejection rate of not less than 50% as determined under the conditions of pressure 1.47 MPa, 1500 ppm NaCl in water and pH 6.5. When the rejection rate is less than 50%, heavy metals permeate through the membrane and enter into the filtrate. The upper limit, if imposed, may be not more than 99.5%. When this limit is exceeded, nitrate and sodium ions hardly permeate through the membrane.

In the alkali neutralizing tank 7, an aqueous solution of the alkali stored in the alkali reservoir 8 is introduced through a pipeline 14 to neutralize the first filtrate to pH 6.0 to 8.0. The alkali may for example be sodium hydroxide or potassium hydroxide, and is preferably sodium hydroxide.

The first filtrate neutralized in the alkali neutralizing tank 7 is fed to a second reverse osmosis membrane module 9 through a pipeline 15. Here, the neutralized first filtrate is fractionated by the second reverse osmosis membrane of the module 9 into a second concentrate and a second filtrate. The second concentrate is discarded from the system through a discharge line 16. This second concentrate to be discarded is the water obtained by the neutralization and concentration of the acidic filtrate available from the first reverse osmosis membrane treatment, thus being water substantially free of the heavy metal and other substances derived from the main components of the chemical conversion reagent and its volume having been reduced to only as small as about one-tenth, at most, of the volume of the washes withdrawn. Therefore, this water can be pooled with other plant effluents and easily treated together without imposing any substantial burden on waste disposal.

On the other hand, the second filtrate has an electrical conductivity of about several tens of $\mu$S/cm and can be utilized as cleaning water without an untoward effect. This second filtrate is fed to a an arbitrary stage-cleaning tank, preferably said last cleaning bath tank 3 as fresh aqueous wash through a second filtrate withdrawal pipeline 17 connected at one end to the filtrate outlet of said second reverse osmosis membrane module 9. When a mist spray is utilized in the last aqueous cleaning stage, the second filtrate may be optionally pooled once, subjected to a higher-order treatment such as ion exchange treatment, and reused.

The second reverse osmosis membrane should be a sodium chloride rejection rate of not less than 90% as determined under the conditions of pressure=0.74 MPa, 500 ppm NaCl/$H_2O$, and pH 6.5. When the rejection rate is less than 90%, the filtrate has too a high electrical conductivity to be used as aqueous wash.

The method for recovery of aqueous wash according to the present invention utilizes the first concentrate and the second filtrate and the recovery rate may be as high as not less than 90% of the volume of the cleaning water.

According to the described method for recovery of aqueous wash as applied to the reverse osmosis membrane treatment of washes in the phosphate process for surface chemical conversion of shaped metal products, the useful components in the washes can be efficiently recovered and, at the same time, a filtrate water of high quality could be obtained by adjusting the pH of the washes and of the filtrate.

EXAMPLES

The following examples illustrate the present invention in further detail and should by no means be construed as defining the scope of the invention.

Example 1

Recovery of Aqueous Wash-1

A zinc phosphate chemical conversion solution (5 L) of the ion composition shown in Table 1 was diluted with 45 L of industrial water (pH 6.8) having an electrical conductivity of 234 μS/cm and the dilution was used as a model water overflowing the first cleaning tank. This model aqueous wash was adjusted to pH 2.5 with phosphoric acid and subjected to a first reverse osmosis membrane treatment with Membrane Master RUW-5A (Nitto Denko) using a commercial LF10 membrane module under the conditions of treating temperature: 25 to 30° C., pressure: 1.0 to 1.1 MPa, concentrate recycling flow rate: 6.2 to 6.3 L/min, filtrate flow rate 0.3 to 0.6 L/min to give 5 L of a first concentrate and 45 L of a first filtrate. The first filtrate thus obtained was adjusted to pH 6.2 with an aqueous solution of sodium hydroxide and subjected to a second reverse osmosis membrane treatment using Membrane Master RUW-5A (Nitto Denko) having a commercial ES20 membrane module as the second reverse osmosis membrane module under the conditions of treating temperature: 25 to 30° C., pressure: 1.1 to 1.2 MPa, concentrate recycling flow rate: 6.1 to 6.2 L/min, and filtrate flow rate: 1.2 to 1.4 L/min to give 4.5 L of a second concentrate and 40.5 L of a second filtrate. The analyzed ion compositions of the first filtrate, first concentrate, second filtrate and second concentrate are shown in Table 1.

The first concentrate obtained could be reused as the chemical conversion agent and the second filtrate could be reused as aqueous wash. The electrical conductivity was measured with Conductivity Meter DS-12 (Horiba) and the ion concentration was measured with Ion Chromatograph Series 4000 (Dionex) or Atomic Absorption Spectrometer 3300 (Perkin Elmer).

TABLE 1

| Kind of water | Zinc phosphate | Model water after pH adjustment | First concentrate | First filtrate | First filtrate after neutralization | Second concentrate | Second filtrate |
|---|---|---|---|---|---|---|---|
| pH | 3.1 | 2.5 | 2.5 | 2.4 | 6.2 | 6.7 | 6.1 |
| Electrical conductivity (μS/cm) | 19480 | 3830 | 14330 | 2320 | 848 | 5060 | 66 |
| Ion composition (ppm) | | | | | | | |
| Zn ion | 1310 | 135 | 1010 | 0.3 | 0.2 | 1 | 0 |
| Ni ion | 950 | 99.5 | 650 | 0 | 0 | 0.7 | 0 |
| Mn ion | 450 | 52.5 | 356 | 0.1 | 0 | 0.4 | 0 |
| F ion | 1000 | 99.1 | 910 | 79.3 | 77.5 | 94.6 | 3.6 |
| Na ion | 2670 | 284.5 | 1970 | 8.3 | 132 | 900 | 4.9 |
| Si ion | 308 | 33 | 210 | 0 | 0 | 3.1 | 0 |
| Al ion | 119 | 79 | 55.9 | 0 | 0 | 0 | 0 |
| $NO_3$ ion | 9130 | 769 | 3077 | 368 | 352 | 2275 | 6 |
| $PO_4$ ion | 15616 | 2486 | 18596 | 11.3 | 8.1 | 51.9 | 1.1 |

Examples 2 and 3

Recovery of Washes-2 and -3

The phosphate chemical conversion agents (5 L each) of the ion compositions indicated in Tables 2 and 3 were respectively diluted with 45 L of the same industrial water as used in Example 1 and the dilutions were used as model waters overflowing the first cleaning tank. Except that each model water was adjusted and neutralized to the pH value indicated in Table 2 or 3, the procedure of Example 1 was otherwise repeated. The ion compositions are shown in Tables 2 and 3. As in Example 1, a concentrate which could be reused as a chemical conversion agent and a filtrate which could be reused as an aqueous wash were obtained.

TABLE 2

| Kind of water | Zinc phosphate | Model water after pH adjustment | First concentrate | First filtrate | First filtrate after neutralization | Second concentrate | Second filtrate |
|---|---|---|---|---|---|---|---|
| pH | 3.2 | 3 | 3.35 | 2.7 | 6.4 | 6.8 | 5.9 |
| Electrical conductivity (μS/cm) | 23900 | 3440 | 15540 | 1096 | 515 | 3590 | 34.1 |
| Ion composition (ppm) | | | | | | | |
| Zn ion | 1120 | 110 | 755 | 0.2 | 0.3 | 1.7 | 0 |
| Ni ion | 515 | 52.5 | 346 | 0 | 0 | 0.8 | 0 |
| Mn ion | 339 | 32.6 | 239 | 0 | 0 | 0.5 | 0 |

TABLE 2-continued

| Kind of water | Zinc phosphate | Model water after pH adjustment | First concentrate | First filtrate | First filtrate after neutralization | Second concentrate | Second filtrate |
|---|---|---|---|---|---|---|---|
| F ion | 1020 | 100 | 583 | 44 | 41 | 456 | 1.7 |
| Na ion | 4300 | 445 | 2620 | 25 | 65 | 213 | |
| Si ion | 158 | 21 | 131 | 0 | 0 | 1.6 | 0 |
| Al ion | 23 | 2.5 | 1.9 | 0 | 0 | 0 | 0 |
| $NO_3$ ion | 11041 | 1063 | 5313 | 213 | 213 | 2125 | 6 |
| $PO_4$ ion | 15934 | 1768 | 12368 | 4 | 4 | 25 | 0.6 |

TABLE 3

| Kind of water | Zinc phosphate | Model water after pH adjustment | First concentrate | First filtrate | First filtrate after neutralization | Second concentrate | Second filtrate |
|---|---|---|---|---|---|---|---|
| pH | 3 | 2.9 | 3.4 | 2.5 | 6.2 | 6.8 | 5.9 |
| Electrical conductivity ($\mu$S/cm) | 22000 | 3290 | 15300 | 1503 | 673 | 4090 | 25.8 |
| Ion composition (ppm) | | | | | | | |
| Zn ion | 1045 | 98 | 670 | 0.2 | 0.2 | 1.4 | 0 |
| Ni ion | 770 | 76 | 670 | 0 | 0 | 1 | 0 |
| Mn ion | 590 | 55 | 364 | 0 | 0 | 0.6 | 0 |
| F ion | 1076 | 105 | 752 | 47 | 42 | 101 | 1.8 |
| Na ion | 3820 | 412 | 2560 | 20 | 86 | 635 | 3.2 |
| Si ion | 223 | 24 | 172 | 0 | 0 | 0 | 0 |
| Al ion | 21 | 1.8 | 15 | 0 | 0 | 0 | 0 |
| $NO_3$ ion | 11875 | 1175 | 6750 | 313 | 258 | 1300 | 6 |
| $PO_4$ ion | 13139 | 1613 | 12224 | 5 | 6 | 32 | 1 |

Example 4

Study of the Adjusted pH of Washes

The same model water as used in Example 1 were adjusted to the pH values shown in Table 4 and subjected to the first reverse osmosis membrane treatment in the same manner as in Example 1. The results are shown in Table 4.

TABLE 4

| pH as adjusted | 3.1 | 3.0 | 2.9 |
|---|---|---|---|
| pH of the first concentrate | 3.4 | 3.3 | 3.3 |
| pH of the second concentrate | 2.3 | 2.7 | 2.5 |
| Formation of crystalline precipitates | Some | None | None |

When the model water was adjusted to pH 3.1 and subjected to the first reverse osmosis membrane treatment, crystals of zinc phosphate were observed on the reverse osmosis membrane.

Example 5

Study of pH Adjusted by Alkaline Neutralization

The first filtrate in Example 1 were adjusted to the pH values indicated in Table 5 and subjected to the second reverse osmosis membrane treatment as in Example 1. The results are shown in Table 5.

TABLE 5

| pH as adjusted | Electrical conductivity ($\mu$S/cm) Aqueous wash | Electrical conductivity ($\mu$S/cm) Filtrate water | Relative electrical conductivity, filtrate/aqueous wash (%) |
|---|---|---|---|
| 2.5 | 1046 | 655 | 39.2 |
| 3.0 | 609 | 390 | 37.2 |
| 4.0 | 451 | 106 | 79.2 |
| 6.0 | 453 | 43 | 91.8 |
| 7.0 | 471 | 21.9 | 96.0 |
| 8.0 | 479 | 8.7 | 98.2 |

By neutralizing the filtrate from the first reverse osmosis membrane module, a filtrate of high quality could be obtained. Particularly, when the pH of the filtrate was pH 6.0 or higher, the electrical conductivity could be reduced to 50 $\mu$S/cm or less.

What is claimed is:

1. A method for recovery of aqueous wash in a phosphate chemical conversion of a shaped metal product involving carrying out chemical conversion and subsequent cleaning with water, wherein said cleaning with water is performed in one or more stages, said method comprising the steps of:

withdrawing aqueous wash from a first cleaning stage and adjusting the pH of the wash with at least one acid selected from group consisting of phosphoric acid, nitric acid, hydrofluoric acid, hydrosilicofluoric acid and fluoroboric acid, treating said pH-adjusted aqueous wash with a first reverse osmosis membrane to separate it into a first filtrate and a first concentrate, and neutralizing said first filtrate with an alkali and treating the alkali-neutralized filtrate with a second reverse osmosis membrane to separate it into a second filtrate and a second concentrate, said first concentrate being recycled for said phosphate chemical conversion, said second filtrate being recycled as aqueous wash for cleaning, and said second concentrate being discarded from the system.

2. The method for recovery of aqueous wash in a phosphate chemical conversion according to claim 1 wherein, in said pH adjusting step, phosphoric acid is used as the acid and the pH is adjusted to 2.0 to 3.0.

3. An apparatus for metal surface treatment for use in a phosphate chemical conversion of a shaped metal product, which comprises:

phosphate chemical conversion means, means for performing aqueous cleaning in one or more stage, means for withdrawing aqueous wash from a first stage of said aqueous cleaning means and adjusting the pH of aqueous wash with an acid selected from the group consisting of phosphoric acid, nitric acid, hydrofluoric acid, hydrosilicofluoric acid and fluoroboric acid, a first reverse osmosis membrane module for treating the pH-adjusted aqueous wash and comprising an outlet for a filtrate and an outlet for a concentrate, means for alkaline neutralization of said filtrate from said first reverse osmosis membrane module, and a second reverse osmosis membrane module for treating the alkaline-neutralized filtrate comprising an inlet for receiving the alkaline-neutralized filtrate.

4. The apparatus for metal surface treatment according to claims 3, which further comprises a concentrate recycle conduit for recycling, said concentrate from said first reverse osmosis membrane module to said phosphate chemical conversion, and a filtrate recycle conduit for recycling a filtrate from said second reverse osmosis membrane module as aqueous wash for aqueous cleaning.

5. The apparatus for metal surface treatment according to claim 4, wherein said aqueous wash is recycled to a last aqueous cleaning stage.

* * * * *